US011268432B2

(12) United States Patent
Kast et al.

(10) Patent No.: US 11,268,432 B2
(45) Date of Patent: Mar. 8, 2022

(54) EXHAUST SYSTEM

(71) Applicant: Eberspächer Exhaust Technology GmbH, Neunkirchen (DE)

(72) Inventors: Peter Kast, Esslingen (DE); Michael Dentler, Reichenbach (DE); Vincent Eder, Kirchheim/Teck (DE); Oliver Karabateas, Reutlingen (DE); Felix Neumann, Aichwald (DE)

(73) Assignee: PUREM GMBH, Neunkirchen (DE)

( * ) Notice: Subject to any disclaimer, the term of this patent is extended or adjusted under 35 U.S.C. 154(b) by 0 days.

(21) Appl. No.: 17/142,873

(22) Filed: Jan. 6, 2021

(65) Prior Publication Data

US 2021/0215087 A1 Jul. 15, 2021

(30) Foreign Application Priority Data

Jan. 9, 2020 (DE) ..... 10 2020 100 285.8

(51) Int. Cl.
*F01N 13/18* (2010.01)
*F01N 3/021* (2006.01)
*F01N 3/28* (2006.01)

(52) U.S. Cl.
CPC ..... *F01N 13/1827* (2013.01); *F01N 3/0211* (2013.01); *F01N 3/2839* (2013.01); *F01N 13/185* (2013.01); *F01N 13/1855* (2013.01)

(58) Field of Classification Search
CPC .. F01N 13/1827; F01N 3/0211; F01N 3/2839; F01N 13/185; F01N 13/1855; F01N 13/1894; F01N 2450/30; F01N 13/1844
USPC ..... 422/180; 285/363, 408
See application file for complete search history.

(56) References Cited

U.S. PATENT DOCUMENTS 6,632,406 B1 * 10/2003 Michelin ..... F01N 3/0222 422/168
7,393,020 B2 * 7/2008 Hartig ..... F01N 13/1805 277/608
7,779,624 B2 * 8/2010 Belisle ..... F01N 13/009 60/299

(Continued)

FOREIGN PATENT DOCUMENTS

DE 19959955 A1 6/2000
DE 10144613 A1 4/2003

(Continued)

*Primary Examiner* — Tom P Duong
(74) *Attorney, Agent, or Firm* — McGlew and Tuttle, P.C.

(57) ABSTRACT

An internal combustion engine exhaust system includes an exhaust gas treatment unit carried at a carrier. The carrier has a receiving opening (20), receiving the treatment unit, with a first sealing surface (28) enclosing the opening. The exhaust gas treatment unit has a second sealing surface (42), enclosing a treatment unit longitudinal axis, located opposite the first sealing surface. The exhaust gas treatment unit has a third sealing surface (44), enclosing the treatment unit longitudinal axis. A closing element (48), fixable with the exhaust gas treatment unit to the carrier, has a fourth sealing surface (50), located opposite the third sealing surface. A first sealing element (52) is arranged between the first sealing surface and the second sealing surface. A second sealing element (54) is arranged between the third sealing surface and the fourth sealing surface. The first sealing element and the second sealing element are of identical configuration.

20 Claims, 2 Drawing Sheets

(56) References Cited

U.S. PATENT DOCUMENTS

| | | | | |
|---|---|---|---|---|
| 8,328,243 | B2 * | 12/2012 | Matthis | F01N 13/1827<br>285/367 |
| 8,568,661 | B2 * | 10/2013 | Werni | F01N 13/0097<br>422/180 |
| 8,763,375 | B2 * | 7/2014 | Wieland | F01N 3/035<br>60/297 |
| 9,909,698 | B2 * | 3/2018 | Drost | F16L 27/1012 |
| 9,926,956 | B2 * | 3/2018 | Horton | F01N 3/2066 |
| 2006/0053779 | A1 * | 3/2006 | Belisle | F16L 23/08<br>60/299 |
| 2006/0082154 | A1 * | 4/2006 | Hartig | F16L 23/20<br>285/408 |
| 2006/0202480 | A1 * | 9/2006 | Cassel | F16L 23/10<br>285/408 |
| 2011/0074150 | A1 * | 3/2011 | Drost | F16L 27/1012<br>285/363 |

FOREIGN PATENT DOCUMENTS

| | | | |
|---|---|---|---|
| DE | 102008032766 | A1 | 3/2009 |
| DE | 102010034743 | A1 | 2/2012 |
| DE | 102012207960 | B3 | 8/2013 |
| DE | 102013100454 | A1 | 7/2014 |
| EP | 1298289 | A1 | 4/2003 |
| EP | 1701011 | A1 | 9/2006 |
| EP | 2320116 | A1 | 5/2011 |
| EP | 2420656 | A2 | 2/2012 |
| EP | 3792463 | A1 | 3/2021 |
| FR | 2906864 | A1 | 4/2008 |

* cited by examiner

EXHAUST SYSTEM

CROSS REFERENCE TO RELATED APPLICATIONS

This application claims the benefit of priority under 35 U.S.C. § 119 of German Application 10 2020 100 285.8, filed Jan. 9, 2020, the entire contents of which are incorporated herein by reference.

TECHNICAL FIELD

The present invention pertains to an exhaust system for an internal combustion engine in a vehicle.

TECHNICAL BACKGROUND

Exhaust gas treatment units, for example, catalytic converters or particle filters, are used in such exhaust systems to reduce the emission of harmful substances. Since the efficiency of such exhaust gas treatment units can decrease over the operating life or these exhaust gas treatment units may be clogged with soot particles, such exhaust systems may be configured such that there is access to the exhaust gas treatment units, for example, in order to clean or replace these units.

SUMMARY

An object of the present invention is to provide an exhaust system for an internal combustion engine, in which access to the exhaust gas treatment unit is made possible with structurally simple means and at the same time a gastight closing can be reliably guaranteed in the assembled state.

This object is accomplished according to the present invention by an exhaust system for an internal combustion engine, comprising an exhaust gas treatment unit, which is carried at a carrier structure and which is elongated in the direction of an exhaust gas treatment unit longitudinal axis, wherein:

- a receiving opening with an opening central axis for receiving the exhaust gas treatment unit in the carrier structure and a first sealing surface enclosing the opening central axis in a ring shape are provided at the carrier structure,
- a second sealing surface enclosing the exhaust gas treatment unit longitudinal axis in a ring shape is provided at the exhaust gas treatment unit, wherein the second sealing surface is located opposite the first sealing surface when the exhaust gas treatment unit has been received in the carrier structure,
- a third sealing surface enclosing the exhaust gas treatment unit longitudinal axis in a sing shape is provided at the exhaust gas treatment unit, and
- a closing element, which can be fixed together with the exhaust gas treatment unit to the carrier structure, is provided with a fourth ring shape sealing surface, wherein the fourth sealing surface is located opposite the third sealing surface when the closing element has been fixed together with the exhaust gas treatment unit to the carrier structure.

This exhaust system is characterized in that a first sealing element is arranged between the first sealing surface and the second sealing surface, that a second sealing element is arranged between the third sealing surface and the fourth sealing surface, and that the first sealing element and the second sealing element are identical—of identical design to each other, namely have an identical configuration.

The use of sealing elements between the sealing surfaces to be sealed in relation to one another at the carrier structure, at the exhaust gas treatment unit and at the closing element guarantees, on the one hand, that a gastight closing is achieved in the area of the sealing surfaces, which are located opposite one another in pairs despite the possibility of obtaining access to the exhaust gas treatment unit by removing the closing element when the closing element is fixed together with the exhaust gas treatment unit to the carrier structure. On the other hand, since the two sealing elements are identical, particularly configured identically or of identical design to each other, i.e., identical components are used for the first sealing element and the second sealing element, the configuration is simplified. Furthermore, the risk that the sealing elements are incorrectly assigned to the sealing surfaces to be sealed against one another at the time of assembly is eliminated.

In order to guarantee a defined positioning of the sealing elements even in a phase of assembly, for example, before the insertion of an exhaust gas treatment unit into the receiving opening receiving this unit in the carrier structure, it is proposed that the first sealing element and the second sealing element have a ring shape sealing element body, wherein inner clamping sections protruding in a radially inward direction are provided at an inner circumferential area of the sealing element body and outer clamping sections protruding in a radially outward direction are provided at an outer circumferential area of the sealing element body.

In this connection, the sealing elements and the exhaust gas treatment unit can be coordinated with each other such that the first sealing element is clamped with its inner clamping sections at the exhaust gas treatment unit, and that the second sealing element is clamped with its outer clamping sections at the exhaust gas treatment unit. The exhaust gas treatment unit may thus be joined together with the two sealing elements as a preassembled assembly unit and then be inserted into the receiving opening in the carrier structure before the closing element is introduced and fixed together with the exhaust gas treatment unit to the carrier structure.

The exhaust gas treatment unit may comprise a jacket elongated in the direction of the exhaust gas treatment unit longitudinal axis with a first pipe section carrying an exhaust gas treatment assembly unit, with a radial expansion area adjoining the first pipe section in the radial inward direction and providing the second sealing surface and the third sealing surface and with a second pipe section adjoining the radial expansion area in the radial outward direction.

This structure of the exhaust gas treatment unit can be used to position the two sealing elements at this unit in a defined manner. For this purpose, provisions may be made, for example, for the first sealing element with its inner clamping sections to be clamped at the jacket in the area of the first pipe section or in the area of a transition from the first pipe section to the radial expansion area, or/and for the second sealing element with its outer clamping sections to be clamped at the jacket in the area of the second pipe section or in the area of a transition from the radial expansion area to the second pipe section.

In order to support a defined positioning of the exhaust gas treatment unit in relation to the carrier structure by means of the sealing surfaces assigned to one another in pairs as well, it is proposed that the first sealing surface and the second sealing surface have each radially inner and radially outer sealing surface edge areas which are axially offset to one another, or/and that the third sealing surface and the fourth sealing surface have each radially inner and radially outer sealing surface edge areas which are axially offset to one another. Thus, a, for example, conical or cup segment-like structure of same, which supports a centering effect, is provided by the sealing surfaces, which have, in principle, a ring shape configuration, due to the axial extension thereof.

For example, the carrier structure may comprise a carrier part providing the receiving opening, wherein a connecting flange providing the first sealing surface and enclosing the opening central axis with a ring shape is provided at the carrier part.

For fastening the closing element and the exhaust gas treatment unit to the carrier structure, a first fastening element clamping surface enclosing the receiving opening in a ring shape may be provided at the carrier structure, a second ring shape fastening element clamping surface may be provided at the closing element, and a fastening element fixing the closing element together with the exhaust gas treatment unit to the carrier structure may extend radially over the first fastening element clamping surface and the second fastening element clamping surface and the closing element may press against the carrier structure with incorporation of the exhaust gas treatment unit.

In order to support this interaction with the fastening element, it is further proposed that the first fastening element clamping surface and the second fastening element clamping surface be arranged facing away from one another axially and be sloped towards one another from the radially inward direction to the radially outward direction.

For example, the fastening element may be configured in the manner of a clamp.

The first sealing element and the second sealing element may be configured as metal crimp gaskets in a configuration that can be embodied in an especially cost-effective manner.

According to another aspect representing an independent inventive idea, which may, of course, also be combined in conjunction with the above configuration aspects, it is proposed that the first sealing surface and the second sealing surface be configured as curved essentially complementary to one another in the axial direction from the radially inward direction to the radially outward direction, or/and that the third sealing surface and the fourth sealing surface be configured as being curved essentially complementary to one another in the axial direction from the radially inward direction to the radially outward direction.

Due to the respective, complementary axial curvature of the sealing surfaces to one another, which sealing surfaces are to be positioned located opposite one another, i.e., for example, the concave shape of the first and third sealing surfaces and the complementary convex shape of the second and fourth sealing surfaces, an interaction of same in the manner of a ball-and-socket joint with convex joint ball and concave joint socket is achieved, which makes it possible to compensate dimensional inaccuracies or maladjustments during the installation of the exhaust gas treatment unit in the carrier structure.

In order to make this interaction in the manner of a ball-and-socket joint especially efficient, it is proposed that the first sealing surface and the second sealing surface be each curved essentially along a circular line from the radially inward direction to the radially outward direction, or/and that the third sealing surface and the fourth sealing surface be each curved essentially along a circular line from the radially inward direction to the radially outward direction. Each of these ring shape surfaces thus forms essentially a segment of a spherical cup.

For a symmetrical configuration, it is further proposed that a center of curvature of the first sealing surface be located approximately on the opening central axis or/and that a center of curvature of the second sealing surface and a center of curvature of the third sealing surface be located on the exhaust gas treatment unit longitudinal axis. This configuration may also be supported by a center of curvature of the fourth sealing surface being located approximately on the opening central axis when the closing element has been fixed together with the exhaust gas treatment unit to the carrier structure.

Especially if the aforementioned sealing elements shall be provided between the sealing surfaces, which are located opposite each other in pairs, to prepare the installation space needed for receiving these sealing elements while maintaining the ball-and-socket joint functionality, it is proposed that a radius of curvature of the second sealing surface be smaller than a radius of curvature of the first sealing surface, or/and that a radius of curvature of the fourth sealing surface be smaller than a radius of curvature of the third sealing surface, or/and that a radius of curvature of the third sealing surface be smaller than a radius of curvature of the second sealing surface.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
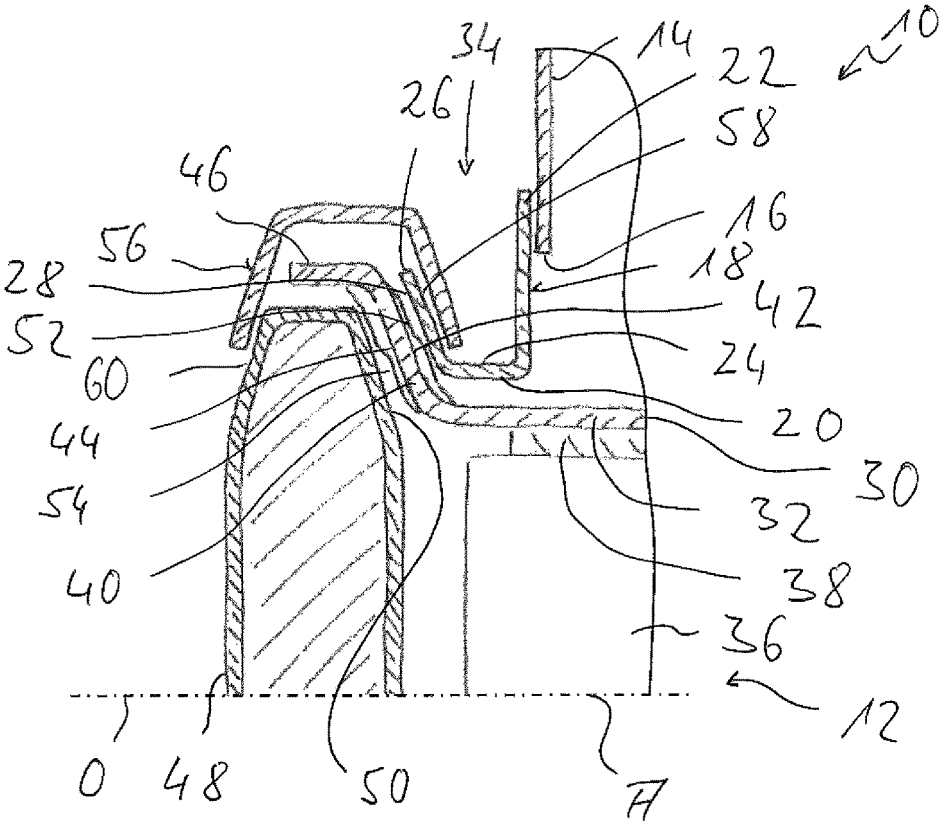
FIG. 1 is a partial longitudinal sectional view of an exhaust system.

Referring to the drawings, FIG. 1 shows, in a partial longitudinal sectional view, an exhaust system generally designated by 10. FIG. 1 shows an area of the exhaust system 10, in which an exhaust gas treatment unit 12 is inserted into a housing 14 of the exhaust system 10.

The housing 14 has a housing opening 16. A carrier part 18, which has a ring shape and is provided, for example, as a shaped sheet metal part, in the area of the housing opening 16, is fixed, for example, by welding to the housing 14 with a connecting flange 22. With a carrier ring shape structure, the carrier part 18 provides a receiving opening 20 with an opening central axis O for the exhaust gas treatment unit 12. Starting from an approximately cylindrical section 24, extending approximately radially at the connecting flange 22 and extending approximately radially in relation to the opening central axis O, the carrier part 18 has another connecting flange 26 positioned obliquely in the radially outward direction away from the cylindrical section 24 and thus away from the receiving opening 20 and in the direction away from the housing 14. A first sealing surface 28 is provided at this connecting flange 26 on a connecting flange side oriented away from the housing 14. The radial inner sealing surface edge area and the radially outer sealing surface edge area of the first sealing surface 28 are also located offset axially to one another in relation to the opening central axis O because of the sloped orientation of the connecting flange 26.

The exhaust gas treatment unit 12, which generally may be referred to as a cartridge, comprises a jacket 30 made of sheet metal material. The jacket 30 has a, for example, essentially cylindrical first pipe section 32, which is elongated in the direction of an exhaust gas treatment unit longitudinal axis A. The exhaust gas treatment unit longitudinal axis A may correspond approximately to the opening central axis O in case of the exhaust gas treatment unit 12 fastened to the carrier part 18 essentially providing a carrier structure 34 as described below.

An exhaust gas treatment assembly unit 36 is held, for example, by a mounting mat 38 enclosing same in the first pipe section 32. The exhaust gas treatment assembly unit 36 may comprise, for example, a catalytic converter block or particle filter block, through which exhaust gas can flow.

The jacket 30 has a radial expansion area 40 adjoining the first pipe section 32. This radial expansion area 40 extends from the first pipe section 32 in the radially outward direction and is, just as the connecting flange 26 of the carrier part 18, has an axially positioned ring shape structure. A second sealing surface 42 is provided at the radial expansion area 40 on the axial side facing the connection part 18, particularly facing the first sealing surface 28 in the assembled state. Because of the positioning of the radial expansion area 40, a radially inner sealing surface edge area and a radially outer sealing surface edge area of the second sealing surface 42 are also axially offset to one another. The same also applies to a third sealing surface 44, which is provided on a side of the radial expansion area 40 facing away from the second sealing surface 42. The radial inner sealing surface edge area and the radially outer sealing surface edge area are also axially offset to one another.

A, for example, approximately cylindrical second pipe section 46 of the jacket 30 adjoins the radial expansion area 40 in the radially outward direction. The jacket 30 has an axial end at the second pipe section 46.

In an especially preferred embodiment, the assembly units interacting with one another and to be inserted into one another, i.e., the carrier element 18, especially in the area of the connecting flange 26, as well as the jacket 30, especially in the area of the radial expansion area 40, are configured with a circular circumferential contour.

The exhaust system 10 further comprises a closing element generally designated by 48. The closing element 48 can be configured, for example, such that, following the exhaust gas treatment assembly unit 36 axially at a distance, the closing element 48 closes the opening formed in the jacket 30 of the exhaust gas treatment unit 12 against the discharge of exhaust gas and the closing element 48 deflects, for example, the exhaust gas flowing through the exhaust gas treatment assembly unit 36 laterally or in the radially outward direction, so that this exhaust gas can flow, for example, through openings provided in the jacket 30 farther to an exhaust gas flow space formed, for example, in the housing 14. However, the closing element 48 may, in principle, also have one or more passage openings, through which the exhaust gas can pass, for example, after such exhaust gas has flowed through the exhaust gas treatment assembly unit 36 of the exhaust gas treatment unit 12, in order to then be sent to other system areas of the exhaust system 10.

The closing element 48, which has a, for example, approximately disk-like configuration, provides a fourth sealing surface 50 in its radially outer area. Moreover, the closing element 48 has a circular circumferential contour in the area of the fourth sealing surface 50. The fourth sealing surface 50 is positioned obliquely, i.e., has an angle of incidence in relation to the opening central axis O or to the exhaust gas treatment unit longitudinal axis A in the assembled state, so that the radially inner sealing surface edge area and the radially outer sealing surface edge area of the fourth sealing surface 50 are also located axially offset to one another.

Different embodiment variants are possible for the configuration of the sealing surfaces 28, 42, 44, 50, as will still be explained below. For example, these sealing surfaces 28, 42, 44, 50 may have a conical or truncated-cone-like configuration, so that they extend approximately uncurved in the axial direction from a radially inward direction to a radially outward direction. In this case, the angle of incidence of all sealing surfaces 28, 42, 44, 50 is advantageously identical.

To obtain a tight closing in the area of the sealing surfaces 28, 42, 44, 50 which are assigned to one another in pairs, a first sealing element 52 is provided between the first sealing surface 28 and the second sealing surface 42 located opposite this first sealing surface 28. Likewise, a second sealing element 54 is provided between the third sealing surface 44 and the fourth sealing surface 50 located opposite this third sealing surface 44. In the assembled state, the two sealing elements 52, 54 are compressed between the sealing surfaces 28, 42, 44, 50 receiving these sealing elements 52, 54 between them and thus produce a gastight closing in the area of the sealing surfaces 28, 42 and 44, 50, which are located opposite one another in pairs.

A fastening element 56, which is configured, for example, as a clamp, is provided to maintain this compression and to fix the closing element 48 together with the exhaust gas treatment unit 12 to the carrier structure 34, which essentially comprises the carrier part 18. This fastening element 56 has an approximately U-shaped or V-shaped configuration and, with fastening element legs positioned in relation to one another, extends over a first fastening element clamping surface 58 provided at the connecting flange 26 as well as a second fastening element clamping surface 60 provided at the closing element 48 in the radial direction. These two fastening element clamping surfaces 58, 60 are positioned in opposite directions to each other, i.e., sloped towards one another from the radially inward direction to the radially outward direction. Due to the tensioning of the fastening element 56 in the radially inward direction, a force acting on the closing element 58 in the direction of the carrier part 18 is generated, so that in the assembled state, the closing element 48 with the incorporation of the radial expansion area 40 of the jacket 30 of the exhaust gas treatment unit 12 and also of the two sealing elements 52, 54 is fixed to the carrier part 18 of the carrier structure 34 and thus also to the housing 14 of the exhaust system 10.

Figure 2:
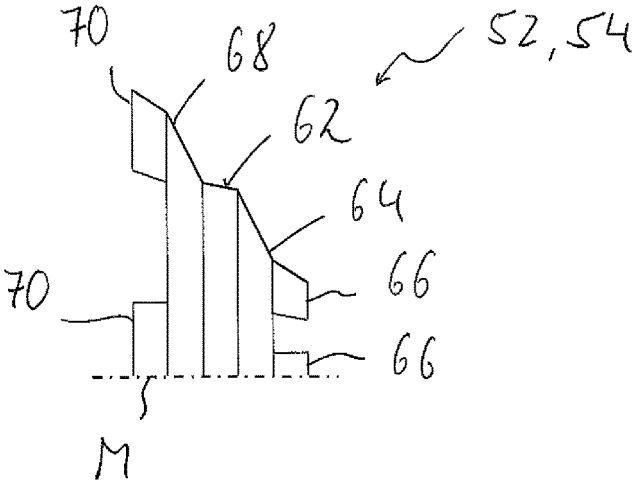
FIG. 2 is a partial longitudinal sectional view of a sealing element of the exhaust system from FIG. 1.

FIG. 2 shows the configuration of the sealing elements 52, 54, which are identical—of identical design to one another, i.e., have an identical configuration. These sealing elements 52, 54, which are provided as shaped sheet metal parts, for example, as metal crimp gaskets, have a ring shape, especially circular, ring shape sealing element body 62, which has, in principle, a generally conical shape, in adaptation to the angle of incidence of the sealing surfaces 28, 42, 44, 50. FIG. 2 depicts approximately one quarter of the circular ring shape sealing element body 62. At the upper edge of FIG. 2, the circular ring shape sealing element body 62 is shown at a cross sectional cut, schematically with no cross hatching, with the portions extending downwardly from the cross sectional cut to the longitudinal central axis M being the arcuate inner surface of the circular ring shape sealing element body 62. To obtain the elasticity necessary for the sealing function, the sealing element body 62 may be configured with bulges running around the circumference—extending circumferentially in a circumferential direction, for example, with a bead shape, or, as can be seen in FIG. 2, have an approximately S-shaped or Z-shaped configuration. Inner clamping sections 66 protruding in the radially inward direction are provided at an inner circumferential area 64 of the sealing element body 62. These inner clamping sections 66, which have a strap shape configuration, may be provided with circumferential spacing to one another and are preferably positioned obliquely in relation to the longitudinal central axis M of the sealing element body 62, so that the inner clamping sections 66 extend in the radially inward direction and away from the sealing element body 62.

Outer clamping sections 70 protruding in the radially outward direction from the sealing element body 62 are provided at an outer circumferential area 68 of this sealing element body 62. The outer clamping sections 70 are also provided with circumferential spacing to one another and are positioned in relation to the longitudinal central axis M of the sealing element, so that they extend in the radially outward direction and axially away from the sealing element body 62 in adaptation to the generally approximately conical structure of the sealing elements 52, 54.

The sealing elements 52, 54, which are identical—have an identical configuration (of identical design to each other), are dimensioned such that they can enter into clamping interaction with the jacket 30 of the exhaust gas treatment unit 12 with their inner clamping sections 66 or outer clamping sections 70. To this end, before integrating the exhaust gas treatment unit 12 into the exhaust system 10, the first sealing element 52 is guided axially over the first pipe section 32 of the jacket 30 until this first sealing element 52 is positioned in the area of the second sealing surface 42. The inner clamping sections 66 are dimensioned or coordinated in this case with the outer dimension of the first pipe section 32 such that they are in contact, under tension, with the first pipe section 32 or with a transition area between the first pipe section 32 and the radial expansion area 40 when the first sealing element 52 is pushed onto the jacket 30 and thus generate a clamping holding action for the first sealing element 52.

The second sealing element 54 is inserted into the second pipe section 46 for joining with the exhaust gas treatment unit 12 until the second sealing element 54 is positioned in the area of the third sealing surface 44. In this case, the outer clamping sections 70 are dimensioned or coordinated with the inner dimension of the second pipe section 46 such that the outer clamping sections 70 press against the second pipe section 46 in the radially outward direction and thus provide a clamping holding action for the sealing element 54 when the second sealing element 54 is inserted.

The exhaust gas treatment unit 12 may thus be provided with the two sealing elements 52, 54 as a preassembled assembly unit, in the assembly of which attention does not have to be paid to which of the two sealing elements 52, 54 is installed where, since the two sealing elements 52, 54 are of identical design to each other and each of the two sealing elements 52, 54 could be used both in association with the second sealing surface 42 and in association with the third sealing surface 44 and could be mounted on the exhaust gas treatment unit 12. This reduces the number of different components to be kept ready for the construction of the exhaust system 10 and avoids errors during the assembly.

After the exhaust gas treatment unit 12 has been joined with the two sealing elements 52, 54, this preassembled assembly unit can be inserted through the receiving opening 20 into the housing 14 until the second sealing surface 42 or the first sealing element 52 comes into contact with the first sealing surface 28. After that, the closing element 48 can be inserted axially into the second pipe section 46 until the fourth sealing surface 50 is located opposite the third sealing surface 44 or is in contact with the second sealing element 54.

Subsequently, the fastening element 58 can then be applied from the radially outward direction and can produce a fixed bond of the carrier part 18 with the exhaust gas treatment unit 12 and in the closing element 48 by generating the above-described clamping action and continuing compression of the two sealing elements 52, 54.

It is noted that during this assembly process, for example, the second sealing element 54 could only be inserted if the exhaust gas treatment unit 12 with the first sealing element 52 provided on it has been inserted into the receiving opening 20.

With the above-described configuration, it is possible to accommodate the exhaust gas treatment unit 12 in the exhaust system 10 in case of a configuration that can be embodied structurally simply such that there is access to the exhaust gas treatment unit 12, for example, in order to clean or replace same. A tight closing is thereby guaranteed by the sealing elements 52, 54, which are of identical design to each other. At the same time, the positioning of the sealing surfaces 28, 42, 44, 50, which interact with one another or with the two sealing elements 52, 54, in relation to the opening central axis O or to the exhaust gas treatment unit longitudinal axis A brings about a centering of the exhaust gas treatment unit 12 in relation to the carrier part 18 and thus supports the precise positioning thereof, so that it can also be guaranteed that an area of the jacket 30 of the exhaust gas treatment unit 12, which area is located in the interior of the housing, which interior is not shown in the figures, can be supported radially in a defined manner by support elements that are provided there as well.

Figure 3:
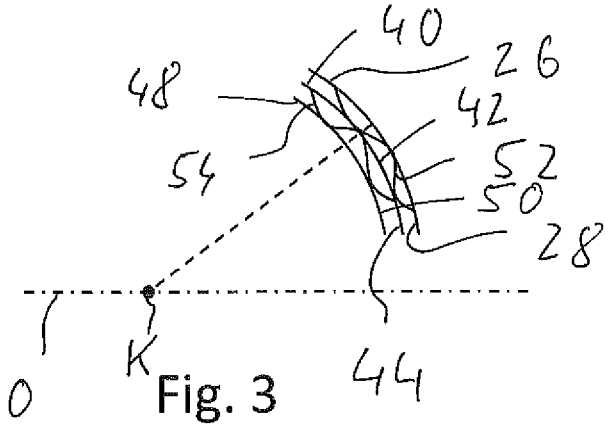
FIG. 3 is a schematic sectional view showing an especially advantageous embodiment of the sealing surfaces and of the assembly units comprising the sealing surfaces.

FIG. 3 illustrates in a schematic diagram an especially advantageous embodiment of the sealing surfaces 28, 42, 44, 50 and of the assembly units comprising these sealing surfaces. In this embodiment, the connecting flange 26 of the carrier part 18, the radial expansion area 40 and the closing element 48 in its radially outer area are shaped such that the sealing surfaces 28, 42, 44, 50 formed thereon not only have a ring shape structure in relation to the opening central axis O or to the exhaust gas treatment unit longitudinal axis A, but also are curved in the axial direction in their course from the radially inward direction to the radially outward direction. In an especially preferred embodiment, the sealing surfaces 28, 42, 44, 50 are configured with a spherical curvature, i.e., that they are curved each along a circular line from the radially inward direction to the radially outward direction.

With this structure, the concavely arched or curved first sealing surface 28 and the complementary convexly arched or curved second sealing surface 42 form a ball-and-socket joint type connection. The concavely arched or curved third sealing surface 44 and the complementary convexly arched or curved fourth sealing surface 50 likewise form another ball-and-socket joint formation, so that the exhaust gas treatment unit 12 with the jacket 30 can be pivoted in a manner of a ball-and-socket joint in relation to the carrier part 18 and also in relation to the closing element 48. In this case, it should be taken into consideration that the position of the closing element 48 in relation to the carrier part 18 can be predefined in a defined manner due to the interaction of these two components with the fastening element 56.

In order to achieve or support this pivotability, the spherically curved sealing surfaces 28, 42, 44, 50 which provide each segments of spherical cups are coordinated with one another such that a respective center of curvature K of these sealing surfaces 28, 42, 44, 50 is located on the opening central axis O, which is especially true of the first sealing surface 28 or the fourth sealing surface 50, when the closing element 48 is fastened to the carrier part 18, or is located on the exhaust gas treatment unit longitudinal axis A, which is especially true of the second sealing surface 42 and the third sealing surface 44 at the radial expansion area 40.

Due to the thus guaranteed pivotability of the exhaust gas treatment unit 12 in relation to the carrier part 18 and the carrier structure 34, it is possible, when inserting the exhaust gas treatment unit 12 into the exhaust system 10, to position the exhaust gas treatment unit such that the end area thereof located in the housing 14 can be supported in a defined manner at support elements provided there even in case of unavoidable production tolerances without formation of deformations or constraints. This may lead to the opening central axis O and the exhaust gas treatment unit longitudinal axis A not being located congruent to one another in the assembled state, but rather being set at an angle to one another. However, this does not compromise the positioning of the closing element 48 and also does not compromise the functionality of the sealing elements 52, 54, which are also arranged between the sealing surfaces 28, 42, 44, 50, which are located opposite one another in pairs, in this embodiment. Since the sealing surfaces 28, 42 and 44, 50, which are located opposite one another in pairs, are always, in principle, positioned in the same manner for the interaction with the two sealing elements 52, 54 regardless of the positions of the opening central axis and of the exhaust gas treatment unit longitudinal axis A deviating from one another because of the spherical or circular curvature of the sealing surfaces 28, 42, 44, 50, the sealing functionality of these sealing elements 52, 54 is not compromised due to such a position adjustment of the exhaust gas treatment unit 12.

In order to provide the installation space needed for receiving the sealing elements 52, 54, which are compressed in the assembled state, when providing this ball-and-socket joint functionality between the sealing surfaces 28, 42 and 44, 50 interacting with one another, the different sealing surfaces are coordinated with one another such that a radius of curvature of the second sealing surface 42 is smaller than a radius of curvature of the first sealing surface 28. This difference in the radius of curvature, while making possible a concentric alignment of these sealing surfaces 28, 42, provides the installation space needed for receiving the first sealing element between the sealing surfaces 28, 42. Correspondingly, for providing the installation space for receiving the second sealing element 54, a radius of curvature of the fourth sealing surface 50 may be smaller than a radius of curvature of the third sealing surface 44. Since, further, the second sealing surface 42 and the third sealing surface 44 are provided at the radial expansion area 40 of the jacket 30, the radius of curvature of the third sealing surface is smaller than the radius of curvature of the second sealing surface 42 to obtain the two ball-and-socket joint formations nested inside one another.

It is noted that the configuration aspect illustrated in FIG. 3 may, of course, be embodied in conjunction with the above-described embodiment of the sealing elements 52, 54, but provides, in principle, an independent aspect of the present invention, which may also be applied when, for example, sealing elements that are not of identical design to each other are used.

While specific embodiments of the invention have been shown and described in detail to illustrate the application of the principles of the invention, it will be understood that the invention may be embodied otherwise without departing from such principles.

What is claimed is:

1. An exhaust system for an internal combustion engine, the exhaust system comprising:

carrier structure;

an exhaust gas treatment unit carried at the carrier structure, the exhaust gas treatment unit being elongated in a direction of an exhaust gas treatment unit longitudinal axis, wherein:

the carrier structure has a receiving opening with an opening central axis for receiving the exhaust gas treatment unit in the carrier structure and has a first sealing surface with a ring shape enclosing the opening central axis;

the exhaust gas treatment unit has a second sealing surface with a ring shape enclosing the exhaust gas treatment unit longitudinal axis, wherein the second sealing surface is located opposite the first sealing surface with the exhaust gas treatment unit received in the carrier structure; and the exhaust gas treatment unit has a third sealing surface with a ring shape enclosing the exhaust gas treatment unit longitudinal axis;

a closing element configured to be fixed, together with the exhaust gas treatment unit, to the carrier structure, wherein:

the closing element has a fourth ring shape sealing surface; and the fourth sealing surface is located opposite the third sealing surface with the closing element fixed, together with the exhaust gas treatment unit, to the carrier structure;

a first sealing element arranged between the first sealing surface and the second sealing surface; and a second sealing element arranged between the third sealing surface and the fourth sealing surface, wherein the first sealing element and the second sealing element have an identical configuration.

2. The exhaust system in accordance with claim 1, wherein:

the first sealing element and the second sealing element each comprise a ring shape sealing element body;

each ring shape sealing element body comprises an inner clamping section protruding in a radially inward direction from an adjacent inner circumferential area of the ring shape sealing element body; and each ring shape sealing element body comprises an outer clamping section protruding in a radially outward direction from an adjacent outer circumferential area of the ring shape sealing element body.

3. The exhaust system in accordance with claim 2, wherein:

the inner clamping section of the first sealing element is clamped at the exhaust gas treatment unit; and the outer clamping sections of the second sealing element is clamped at the exhaust gas treatment unit.

4. The exhaust system in accordance with claim 1, wherein the exhaust gas treatment unit comprises:

an exhaust gas treatment assembly unit; and a jacket elongated in the direction of the exhaust gas treatment unit longitudinal axis, the jacket comprising a first pipe section carrying the exhaust gas treatment assembly unit, a radial expansion area adjoining the first pipe section in a radial inward direction and providing the second sealing surface and a third sealing surface and a second pipe section adjoining the radial expansion area in the radial outward direction.

5. The exhaust system in accordance with claim 3, wherein:

the exhaust gas treatment unit comprises: an exhaust gas treatment assembly unit; and a jacket elongated in the direction of the exhaust gas treatment unit longitudinal axis, the jacket comprising a first pipe section carrying the exhaust gas treatment assembly unit, a radial expansion area adjoining the first pipe section in a radial inward direction and providing the second sealing surface and a third sealing surface and a second pipe section adjoining the radial expansion area in the radial outward direction; and wherein:

the inner clamping section of the first sealing element is clamped at the jacket in an area of the first pipe section or in the area of a transition from the first pipe section to the radial expansion area or the outer clamping section; or the outer clamping section of the second sealing element is clamped at the jacket in an area of the second pipe section or in the area of a transition from the radial expansion area to the second pipe section; or the inner clamping section of the first sealing element is clamped at the jacket in an area of the first pipe section or in the area of a transition from the first pipe section to the radial expansion area or the outer clamping section and the outer clamping section of the second sealing element is clamped at the jacket in an area of the second pipe section or in the area of a transition from the radial expansion area to the second pipe section.

6. The exhaust system in accordance with claim 1, wherein:

the first sealing surface and the second sealing surface each have radially inner and radially outer sealing surface edge areas which are axially offset to one another; or the third sealing surface and the fourth sealing surface each have radially inner and radially outer sealing surface edge areas which are axially offset to one another; or the first sealing surface and the second sealing surface each have radially inner and radially outer sealing surface edge areas which are axially offset to one another or and the third sealing surface and the fourth sealing surface each have radially inner and radially outer sealing surface edge areas which are axially offset to one another.

7. The exhaust system in accordance with claim 1, wherein:

the carrier structure comprises a carrier part providing the receiving opening;

a ring shape connecting flange provides the first sealing surface and encloses the opening central axis at the carrier part.

8. The exhaust system in accordance with claim 1, further comprising a fastening element, wherein:

the carrier structure provides a ring shape first fastening element clamping surface enclosing the receiving opening;

the closing element provides a ring shape second fastening element clamping surface;

the fastening element fixes the closing element together with the exhaust gas treatment unit, to the carrier structure and extends radially over the first fastening element clamping surface and over the second fastening element clamping surface; and the closing element presses against the carrier structure with the exhaust gas treatment unit carried at the carrier structure.

9. The exhaust system in accordance with claim 8, wherein the first fastening element clamping surface and the second fastening element clamping surface are arranged facing away from one another axially and are sloped towards one another from the radially inward direction to the radially outward direction.

10. The exhaust system in accordance with claim 8, wherein the fastening element comprises a clamp.

11. The exhaust system in accordance with claim 1, wherein the first sealing element and the second sealing element are configured as metal crimp gaskets.

12. The exhaust system in accordance with claim 1, wherein:

the first sealing surface and the second sealing surface are configured to be curved essentially complementary to one another in an axial direction from a radially inward direction to a radially outward direction; or the third sealing surface and the fourth sealing surface are configured to be curved essentially complementary to one another in the axial direction from the radially inward direction to the radially outward direction; or the first sealing surface and the second sealing surface are configured to be curved essentially complementary to one another in the axial direction from the radially inward direction to the radially outward direction and the third sealing surface and the fourth sealing surface are configured to be curved essentially complementary to one another in the axial direction from the radially inward direction to the radially outward direction.

13. The exhaust system in accordance with claim 12, wherein:

the first sealing surface and the second sealing surface are each curved essentially along a circular line from a radially inward direction to a radially outward direction; or the third sealing surface and the fourth sealing surface are each curved essentially along a circular line from the radially inward direction to the radially outward direction; or the first sealing surface and the second sealing surface are each curved essentially along a circular line from the radially inward direction to a radially outward direction and the third sealing surface and the fourth sealing surface are each curved essentially along a circular line from the radially inward direction to the radially outward direction.

14. The exhaust system in accordance with claim 13, wherein:

a center of curvature of the first sealing surface is located on the opening central axis; or a center of curvature of the second sealing surface and a center of curvature of the third sealing surface are located on the exhaust gas treatment unit longitudinal axis; or a center of curvature of the first sealing surface is located on the opening central axis and a center of curvature of the second sealing surface and a center of curvature of the third sealing surface are located on the exhaust gas treatment unit longitudinal axis.

15. The exhaust system in accordance with claim 13, wherein with the closing element fixed together with the exhaust gas treatment unit to the carrier structure, a center of curvature of the fourth sealing surface is located on the opening central axis.

16. The exhaust system in accordance with claim 13, wherein:

a radius of curvature of the second sealing surface is smaller than a radius of curvature of the first sealing surface; or a radius of curvature of the fourth sealing surface is smaller than a radius of curvature of the third sealing surface; or a radius of curvature of the third sealing surface is smaller than a radius of curvature of the second sealing surface; or any one or more of:

a radius of curvature of the second sealing surface is smaller than a radius of curvature of the first sealing surface; and a radius of curvature of the fourth sealing surface is smaller than a radius of curvature of the third sealing surface; and a radius of curvature of the third sealing surface is smaller than a radius of curvature of the second sealing surface.

17. An exhaust system for an internal combustion engine, the exhaust system comprising:

carrier structure;

an exhaust gas treatment unit carried at the carrier structure, the exhaust gas treatment unit being elongated in a direction of an exhaust gas treatment unit longitudinal axis, wherein:

the carrier structure has a receiving opening with an opening central axis for receiving the exhaust gas treatment unit in the carrier structure and has a first sealing surface with a ring shape enclosing the opening central axis;

the exhaust gas treatment unit has a second sealing surface with a ring shape enclosing the exhaust gas treatment unit longitudinal axis, wherein the second sealing surface is located opposite the first sealing surface with the exhaust gas treatment unit received in the carrier structure; and the exhaust gas treatment unit has a third sealing surface with a ring shape enclosing the exhaust gas treatment unit longitudinal axis;

a closing element configured to be fixed, together with the exhaust gas treatment unit, to the carrier structure, wherein:

the closing element has a fourth ring shape sealing surface; and the fourth sealing surface is located opposite the third sealing surface with the closing element fixed, together with the exhaust gas treatment unit, to the carrier structure, wherein:

the first sealing surface and the second sealing surface are configured to be curved essentially complementary to one another in an axial direction from a radially inward direction to a radially outward direction; or the third sealing surface and the fourth sealing surface are configured to be curved essentially complementary to one another in the axial direction from the radially inward direction to the radially outward direction; or the first sealing surface and the second sealing surface are configured to be curved essentially complementary to one another in the axial direction from the radially inward direction to the radially outward direction and the third sealing surface and the fourth sealing surface are configured to be curved essentially complementary to one another in the axial direction from the radially inward direction to the radially outward direction.

18. The exhaust system in accordance with claim 17, wherein:

the first sealing surface and the second sealing surface are each curved essentially along a circular line from a radially inward direction to a radially outward direction; or the third sealing surface and the fourth sealing surface are each curved essentially along a circular line from the radially inward direction to the radially outward direction; or the first sealing surface and the second sealing surface are each curved essentially along a circular line from the radially inward direction to a radially outward direction and the third sealing surface and the fourth sealing surface are each curved essentially along a circular line from the radially inward direction to the radially outward direction.

19. The exhaust system in accordance with claim 18, wherein:

a center of curvature of the first sealing surface is located on the opening central axis; or a center of curvature of the second sealing surface and a center of curvature of the third sealing surface are located on the exhaust gas treatment unit longitudinal axis; or a center of curvature of the first sealing surface is located on the opening central axis and a center of curvature of the second sealing surface and a center of curvature of the third sealing surface are located on the exhaust gas treatment unit longitudinal axis.

20. The exhaust system in accordance with claim 18, wherein with the closing element fixed together with the exhaust gas treatment unit to the carrier structure, a center of curvature of the fourth sealing surface is located on the opening central axis.

* * * * *